United States Patent [19]

Burt

[11] Patent Number: 4,861,030

[45] Date of Patent: Aug. 29, 1989

[54] TWO-HANDED RACQUET

[76] Inventor: Lionel J. Burt, 2504 Armour La., Redondo Beach, Calif. 90278

[21] Appl. No.: 228,164

[22] Filed: Aug. 4, 1988

[51] Int. Cl.[4] ..... A63B 49/08

[52] U.S. Cl. ..... 273/73 J; 273/75

[58] Field of Search ..... 273/73 R, 73 J, 75

[56] References Cited

U.S. PATENT DOCUMENTS

| | | | |
|---|---|---|---|
| 2,795,426 | 6/1957 | Wood | 273/73 R |
| 4,029,317 | 6/1977 | Malmstrom | 273/73 J |
| 4,721,305 | 1/1988 | Cudlip | 273/73 J |

FOREIGN PATENT DOCUMENTS

| | | | |
|---|---|---|---|
| 2750217 | 5/1979 | Fed. Rep. of Germany | 273/75 |
| 2528319 | 12/1983 | France | 273/73 J |

*Primary Examiner*—Anton O. Oechsle

*Attorney, Agent, or Firm*—Monty Koslover Assoc.

[57] ABSTRACT

A racquet for use in tennis, racquetball, squash and badminton, having an oval or round head, two symmetrical shafts forming the racquet handle and two grips that are offset from the centerline of the handle. The grips may be angled or paralleled with the centerline. In the preferred embodiment, an adjustable torque stabilizer connects the two grips, providing torsional rigidity and permitting adjustment of the space between the grips. The racquet grips are configured so that the player holds the racquet by both grips, and can simply let go of one grip and swing the racquet with the other hand to play 'forehand' shots, thus eliminating the critical time normally taken to switch grips.

13 Claims, 3 Drawing Sheets

Fig. 1.
Prior Art
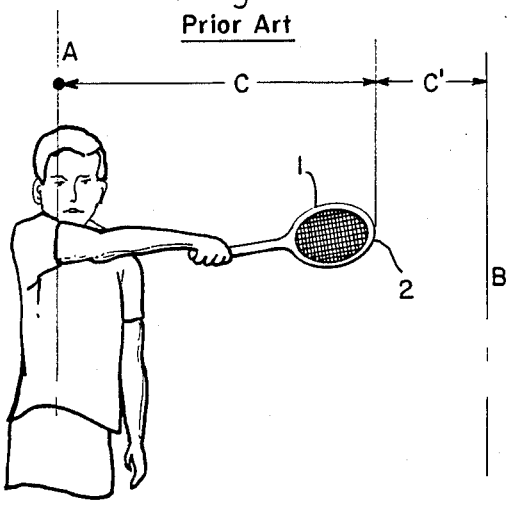
Fig. 2.
Prior Art
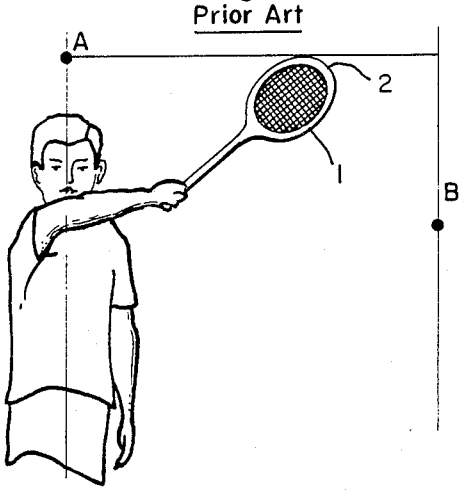
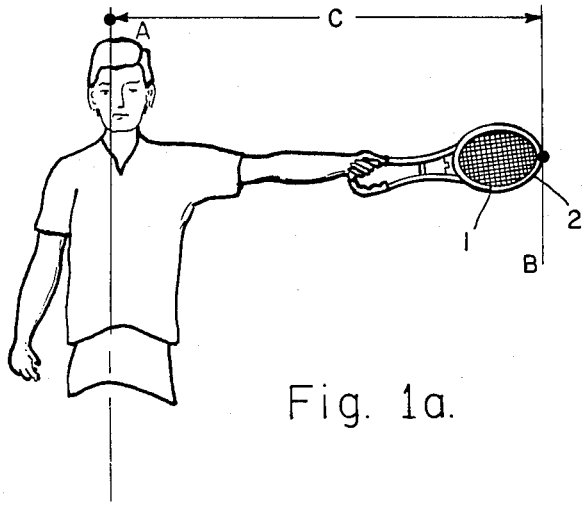
Fig. 1a.
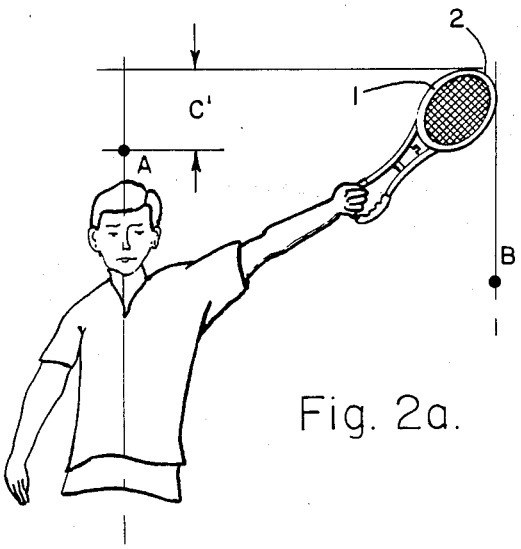
Fig. 2a.
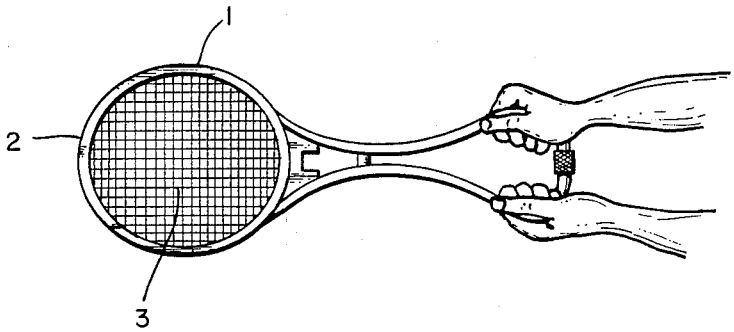
Fig. 3.

Fig. 4.
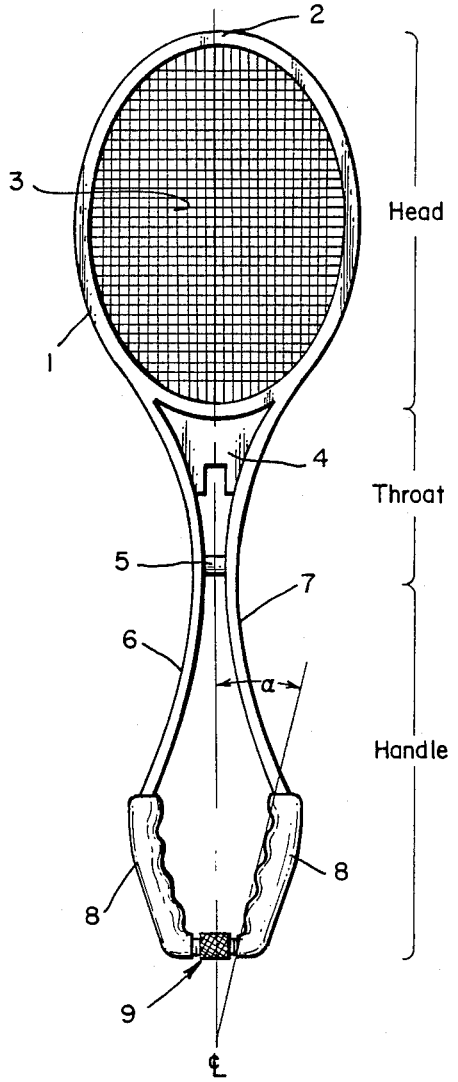
Fig. 5.
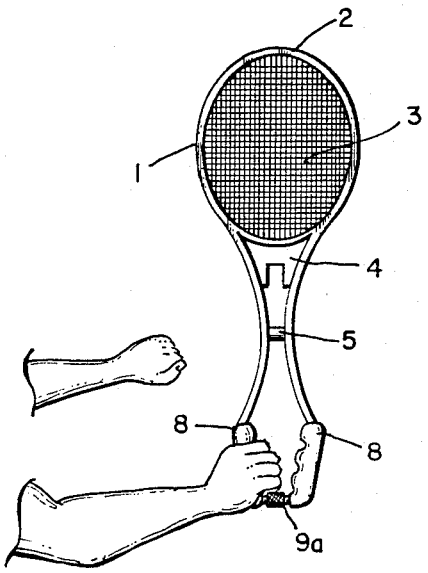
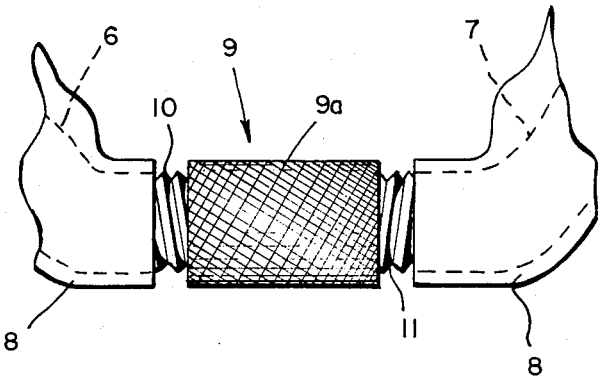
Fig. 6.

TWO-HANDED RACQUET

BACKGROUND OF THE INVENTION

1. Field of the Invention

This invention relates generally to athletic equipment and particularly to racquets used in the play of tennis, racquetball, squash, badminton and the like.

2. Description of the Prior Art

Racquets have been manufactured in various configurations for many years. Variations exist in the shape of the racquet head, the handle, grips, and the materials of construction for the above. However, in all cases, racquets are made with one handle and grip for one-handed play. That is to say, although the player may initially grip the handle with two hands, a play to his right requires letting go of the single handle with his left hand and playing with the right only. For a left-hand play, the player must switch the racquet handle from the right to the left hand, or reach across the body to play with one hand only.

A recent innovation by Cudlip (U.S. Pat. No. 4,721,305), utilizes two parallel shafts for the handle of the racquet. A single grip and a wristband are arranged on the handle so that the racquet is intended for single hand use only. It would still be necessary for the player to switch the racquet handle from one hand to the other. Racquets have been designed with angled grips and handles such as by Lee (U.S. Pat. No. 4,147,348) and by Stoller (U.S. Pat. No. 4,659,080). These improvements increase the comfort of the player and possibly improve hitting power. None of the prior art racquets however, allow the player to play 'forehand' with either hand without a complicated grip-switching procedure, and none cater to or enhance the advantages of ambidextrous players. Thus, there exists a need for just such a racquet that can improve the performance of players.

SUMMARY OF THE INVENTION

The invention comprises a racquet having an oval or round head, two shafts forming the racquet handle and two grips. The grips may be angled or may be paralleled. In the preferred embodiment, an adjustable torque stabilizer connects the two grips. The racquet grips are configured so that the player holds the racquet by both grips at the 'ready' position between shots, and can simply let go of one grip and swing the racquet to one side or the other as the response requires.

Accordingly, it is a principal object of this invention to provide a racquet that will allow a player to play 'forehand' with either hand, and without the need or critical time taken to switch grips.

Another object is to provide a two-handed racquet with a handle grip configuration that allows easy play by either hand and thus enhances the advantages of ambidextrous players.

It is yet another object to provide a two-handed racquet with a means of adjusting the relative position of each of the two grips to suit individual players and at the same time prevent twisting of the handles.

Further objects and advantages of the invention will become apparent from the study of the following portion of the specification, the claims and the attached drawings.

BRIEF DESCRIPTION OF THE DRAWINGS

FIGS. 1 and 1A are sketches comparing the lateral backhand reach of a standard racquet and the forehand lateral reach of the present invention;

FIGS. 2 and 2A are sketches comparing the high backhand reach of a standard racquet and the present invention;

FIG. 3 is a plan or top view of the present invention being held in the 'ready' position;

FIG. 4 is a plan view of the preferred embodiment of the present invention, with major divisions of the racquet indicated as an aid to discussion;

FIG. 5 is an illustration of the preferred embodiment being held by a player using one hand;

FIG. 6 is a view of the adjustable torque stabilizer that is used to hold the grips of the preferred embodiment at a set distance apart while countering twisting of the handle shafts;

DESCRIPTION OF THE PREFERRED AND ALTERNATE EMBODIMENTS

Figure 7:
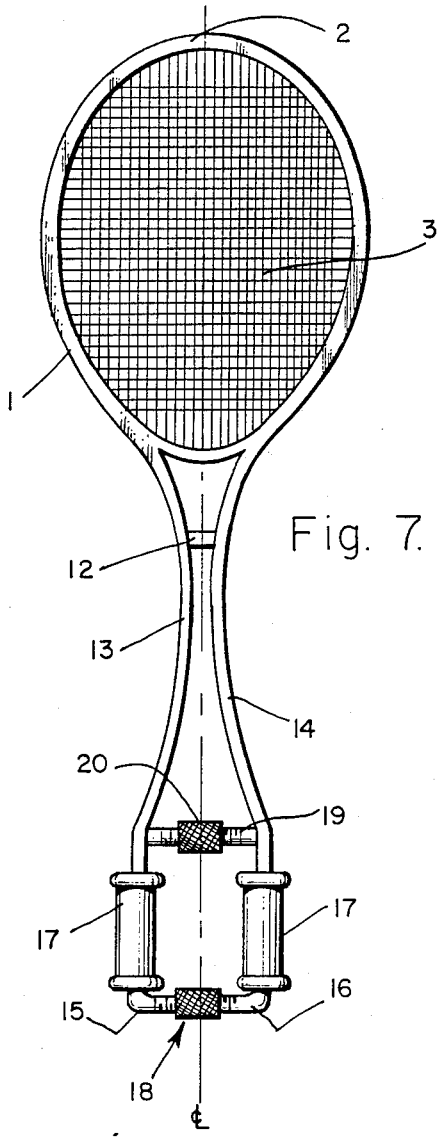
FIG. 7 is a plan view of a first alternate embodiment of the present invention.

In describing the embodiments of the invention illustrated in the drawings, specific terminology used in the sport of tennis will be resorted to for the sake of clarity. However, it is not intended to be limited to the specific terms so selected, and it is to be understood that each specific term includes all technical equivalents which operate in a similar manner to accomplish a similar purpose.

Referring particularly to FIG. 1, there is shown a view of a player making a backhand lateral reach with a standard racquet. In this typical play as shown, the racquet is held by the right hand reaching across the chest with the head 1 of the racquet held vertically. The distance C from the body center to the crown 2 of the racquet marks the farthest reach. Depending on where the ball is, the desired reach, without moving the body, could be from point A to point B. However, point B could not be attained without moving the body laterally a distance indicated as C'. Referring now to FIG. 1A, there is shown a player making a forehand lateral reach with a two-handed racquet of the present invention. The head 1 of the racquet is extended so that its crown 2 attains point B. Measurements taken in tests for a 6 ft. tall man, indicated an increase of 20 inches in reach C using the two-handed racquet compared with the standard single-handed racquet. It is evident, that in order for the player to achieve the reach shown in FIG. 1A but using a standard racquet, he or she would have had to switch the racquet from the right to the left hand, costing valuable time.

Refer now to FIG. 2. This sketch shows a view of a player making a high backhand reach with a standard racquet. The head 1 of the racquet is held so that its crown 2 reaches a height A above and to the left of the player. Without reaching across the face, the racquet can not be raised much higher. Furthermore, in this position, the forearm and the racquet handle are not aligned for optimum strength. Contrast this situation with the illustration shown in FIG. 2A. The player here is making a high forehand reach with a two-handed racquet of the present invention. An increase of 15 to 20

(C') inches in the height of the reach was measured compared with the backhand reach using a standard racquet. Again, this height could have been accomplished using a standard racquet, but only after switching the racquet from the right to left hand. The present invention is for the purpose of avoiding the need for such switching of grips.

Referring to FIG. 3, there is shown a top view of a two-handed racquet of the present invention being held in the 'ready' position. In this position, the head 1 of the racquet is held in front of the player with the racquet face 3 horizontal. Both hands hold the grips. When it is necessary to play to one side or the other, the player simply lets go of the grips with one hand and with the other hand still holding the racquet, swings the racquet away as shown in FIG. 5. A discussion of the various modes of playing tennis from a professional point of view is presented later. The benefits and advantages of the two-handed racquet are clearly evident.

To distinguish the present invention from the standard racquet it is called the '2/Fore racquet' indicating that forehand returns are accommodated on either side of the player.

FIG. 4 is a plan view of the preferred embodiment of the two-handed racquet or 2/Fore racquet. The accepted terms for the main divisions of the racquet are the head, the throat and the handle as indicated. In the handle, the grips 8 are angularly disposed from the major axis or centerline of the racquet by an $\alpha$ angle of 12 to 20 degrees. Studies have shown that angled grips allow for straighter forearm alignment with the axis of the handle and the 'sweet spot' on the face 3 of the racquet. For this configuration, an oval head 1 shape is preferred. The left shaft 6 and right shaft 7 are curved symmetrically for spring and to accommodate the angular placement and separation of the grips 8. It should be noted that the terms 'left shaft' and 'right shaft' are used here only for convenience in definition. Since the shafts are symmetrical, the 'left' or 'right' side are by choice. A yoke 4 and fixed bridge 5 are located and attached in the throat area. The yoke 4 and gusset 5 are made of plastic material and are attached for the purpose of providing torsional rigidity to the throat of the racquet. Since the handle is an open frame construction, the requirement for torsional rigidity, that is to say resistance to racquet twisting, extends to the grips 8. Thus a torque stabilizer means 9 is included at the bottom of the grips 9. In this embodiment, the torque stabilizer means 9 is adjustable. By twisting a cylindrical sleeve on the torque stabilizer, the player can adjust the distance between grips 8 and also the angle $\alpha$ with the centerline of the handle so as to make the forearm in alignment with the handle axis and the 'sweet spot' of the racquet. A second fixed bridge similar to 5 and not shown in FIG. 4, may be located between shafts 6 and 7 just above the grips 8. The racquet materials used for the frame may be typically of light weight metal or composition materials, such as boron, graphite, wood or plastics. Aluminum tubing or extrusion is favored for the handle section. The grips 8 may be of rubber or plastic and may incorporate finger grooves to fit the hand of the player.

A detailed view of the torque stabilizer means 9 is shown in FIG. 6. In the preferred embodiment illustrated, the torque stabilizer 9 comprises an internally threaded sleeve 9A of tubing and two threaded ends respectively of the left shaft 6 and right shaft 7. The left and right shafts 6 and 7, after passing through the grips 8 are bent sharply so that the shaft ends are transverse to the grips and perpendicular to the center line of the handle. These shaft ends 6 and 7 are each threaded with a right-hand thread 10 on one side and a left-hand thread 11 on the other. The outside surface of the threaded sleeve 9A is knurled for an easy grip. Thus, rotating threaded sleeve 9A in one direction pulls the grips closer while rotating in the other direction pushes them further apart.

Referring particularly to FIG. 7, there is shown a plan view of a first alternate embodiment of the present invention. In this embodiment, the two grips 17 are placed in parallel offset configuration a distance apart and are not angled. The racquet head 1 is oval shaped, and the left shaft 13 and right shaft 14 are curved symmetrically for spring and to accommodate the spacing apart of the grips 17. A fixed bridge 12 made of plastic is located in the throat area and attached to the shafts in order to provide torsional rigidity. The left and right shafts 13 and 14, after passing through the grips 17, are bent transversely 15 and 16 to the grips, and form part of first torque stabilizer means 18. A second torque stabilizer means 19 is welded to the shafts 13 and 14. The second torque stabilizer means 19 is comprised of a second internally threaded sleeve 20 and two tubes having threaded ends.

Figure 9:
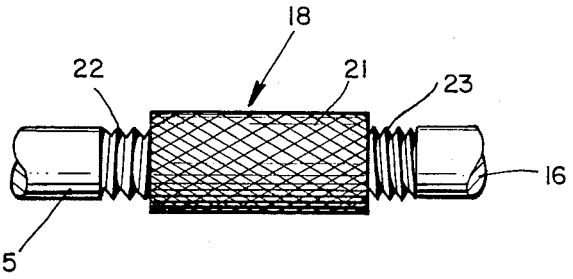
FIG. 9 is a cross-section view of the adjustable torque stabilizers that are used to hold the grips of the first alternate embodiment of the present invention.

FIG. 9 is a detailed view of first torque stabilizer means 18 which is identical in mechanization to second torque stabilizer means 19. In the embodiment, the torque stabilizer comprises an internally threaded sleeve 21 and the two transverse ends 15 and 16 of the shafts. As in the preferred embodiment of FIGS. 4 and 6, the shaft ends 15 and 16 are each threaded with a right-hand thread on one side and a left-hand thread on the other. The outside surface of the threaded sleeve 21 is knurled for an easy grip. Since both torque stabilizers are adjustable and the grips 17 are parallel offset with the handle centerline, the space between grips may be varied considerably to accommodate various size hands. The grips 17 are round or oval shaped and may incorporate finger grooves. The racquet materials to be used are the same as described for the preferred embodiment, with light weight metal tubing favored for the frame.

Figure 8:
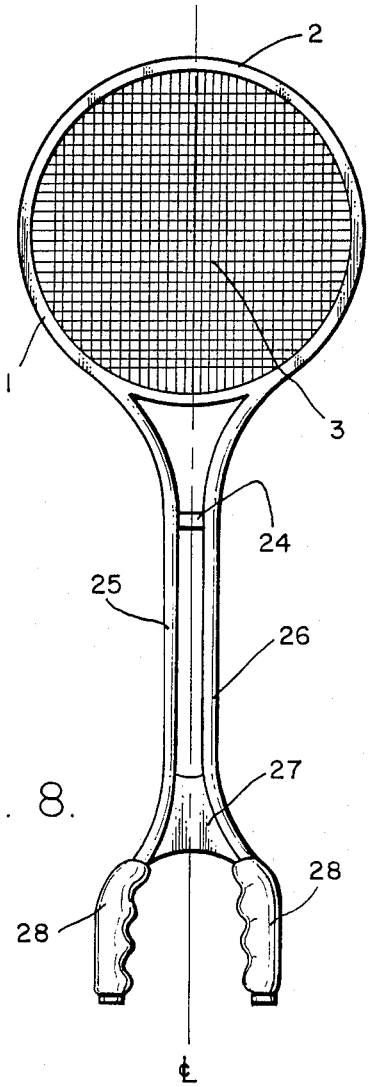
FIG. 8 is a plan view of a second alternate embodiment of the present invention.

The 2/Fore racquet embodiments which have been described allow for a single-handed forehand stroke on both sides. However, there are some shots that players might still prefer to perform two-handed. The narrow handle width in the embodiment shown in FIG. 8 allows the player's second hand to be on the racquet handle with approximately the same 'grip feel' as a standard single-handle racquet. In this second alternate embodiment, the preferred shape of the racquet head 1 is round, although it could be oval. The two shafts 25 and 26 forming the handle are paralleled closely together for most of the length and then flared out to accommodate two parallel offset grips 28. A plastic fixed bridge 24 in the throat section provides torsional rigidity to both shafts in the upper part of the frame, and a non-adjustable plastic gusset piece 27 located just above the grips 28 provides torsional rigidity to the handle. The grips 28 are shown in parallel offset with the center line of the handle and could be shaped to the player's hand. However, as an alternate variation, the grips could also be angled 12 to 20 degrees with the centerline as desired. The racquet materials to be used are the same as described earlier for the previous embodiments.

The following discusses several aspects of the game of tennis by way of illuminating the particular advantages and uses of the 2/Fore racquet.

1. THE SERVE

In tennis, the only shot that your opponent totally controls is the serve. The server can, theoretically at least, hit the ball to either side of the receiver and spin the ball either towards or away from the receiver.

There are inherent bio-mechanical weaknesses in defending against the server. With a standard single-handed racquet a backhand return shot may be required on either side, causing physical reach difficulty for a right-handed player or a lefty. According to Peter Burwash, a teaching tennis pro and a Davis Cup player, anticipation of the server's shot direction and the probable response is an important strategic element in tennis. With the two-handed 2/Fore racquet, the inherent weakness vanishes because the receiver can use the stronger response on either side whether backhand or forehand. This multiple response possibility diminishes to a great degree, the server's tactical advantage.

2. CHANGE OF GRIP HOLD

Any player using a traditional standard racquet, and who plays forehand to one side and backhand on the other, must change his grip hold on the handle between each shot to the alternate side. This aspect is documented in many teaching manuals, which include strategies for reducing the change-over time.

When a change of grip hold is performed, it must be accomplished in the time interval from the moment the receiver can ascertain to which side of his body the ball is coming, to the moment he can get the racquet head on that side. Usually, this time interval is very short. Often a shot is missed because, in changing the grip hold, there was not enough time to get the racquet head back. Or possibly, in getting the racquet head back, there was no time to change the grip hold.

This two-step procedure will not apply to a player using the 2/Fore racquet. In the 'ready' stance, both hands are on the grips in the forehand position. This means that no chance of grip hold is necessary no matter which side the ball comes to. The player simply swings the racquet back to the appropriate side, letting go of one hand. As tennis pros will testify, the difference between two steps taken and one step can often make the difference to the outcome of a match. In this case, an arm motion can often save a point that would otherwise be lost if feet and torso movement had to be added to the stroke.

3. BILATERAL SYMMETRY PLAYS

Bilateral symmetry play, that is the ability to play the same strokes on either side is not the norm. To some extent this is a matter of whether one is ambidextrous or not. A number of studies have been performed and reported in 'Perceptual and Motor Skills' related to this matter. For example, Lewandowski et al., in 'Perceptual and Motor Skills', 1982, 55, 311–314, noted that hand grip performance was not an accurate predictor of hand preference in either males or females. Augustyn and Peters writing in 'Perceptual and Motor Skills', 1986, 63, 1115–1118, found that symmetry in the arms does not apparently extend to the feet. That is to say, both left-handers and right-handers have the same right foot advantage. According to Tan, in 'Perceptual and Motor Skills', 1985, 60, 625–626, studies concluded that there was no significant difference in the velocities of nerve conduction on the left and right sides of left-handed and right-handed subjects. On the basis of the above, it is clear that everyone having two arms and two legs may be considered ambidextrous to some extent.

Even for fully ambidextrous players it would be laughable to suggest that throwing the racquet from one hand to the other should become a regular part of tennis play. Bilateral symmetry plays are therefore not developed because there has not been a racquet that would harmoniously accommodate it. The 2/Fore racquet with its two hand grips, on the other hand invites bilateral symmetry plays, adding shots that are not available in the standard racquet repertoire. Consider the following: Any player willing to devote the energy to developing a forehand stroke on the non-preferred side, will possess a distinct advantage over an opponent using a standard racquet in at least three common tennis play situations.

These are:

1. In defense of a serve,
2. In a low, running, reaching shot to what would ordinarily be called the 'backhand' side,
3. In a high-bounce shot to the 'backhand' side.

In view of the foregoing, it is believed that the present invention, referred to as the 2/Fore racquet, constitutes an advance in equipment for the games of tennis, racquetball, squash and the like. The first high level ambidextrous competitor using it will set a new standard of play that others at whatever level of bilateral propensity, will have to meet. This should bring a new vigor to the fore.

From the above description and discussion, it is apparent that the preferred embodiment and alternate embodiments presented achieve the object of the present invention. Various modifications of the embodiments depicted will be apparent to those skilled in the art. These and other alternatives are considered to be equivalent and within the spirit and scope of the present invention.

Having described the invention, what is claimed is:

1. In a racquet of the type including a frame defining a racquet head, the frame extensions from said racquet head converging to a throat and extending to form a handle; the improvement comprising the division of said handle into two separate symmetrically shaped shafts that are formed and spaced to dispose two separate grips set angularly apart from the major axis or centerline of said racquet by an angle of 12 to 20 degrees such that a player can comfortably hold both grips at the same time; the bottom or butt end of said grips being joined by a torque stabilizer means, said torque stabilizer means providing torsional rigidity to the lower handle portion of said racquet and also a means of adjusting the distance between said grips; said grips having an adjustable angle set with the major axis of said racquet so as to allow the player to align the forearm with the handle axis and the 'sweet spot' of the racquet head; said two grips being mounted on two separated shafts provided for the purpose of permitting a two-handed hold on said racquet, allowing a player to play 'forehand' with either hand without the need to switch grip holds.

2. The racquet of claim 1 wherein:

said torque stabilizer means includes an internally threaded sleeve of tubing and two threaded ends of the shafts that have passed through the grips and have been bent sharply so that the shaft ends are transverse to the grips and perpendicular to the centerline of the handle; said shaft ends being threaded at one end with a right-hand thread and the other end with a left-hand thread; said threaded sleeve having an outside surface that is knurled for an easy grip; said torque stabilizer means permitting the adjustment of spacing the grips apart by rotation of said threaded sleeve in one direction or the other.

3. A racquet as in claim 1 wherein:

a yoke and a fixed bridge are located and attached in the throat area for the purpose of providing torsional rigidity to the throat of the racquet; said yoke and fixed bridge being made of plastic material.

4. A racquet as in claim 1 wherein:

said racquet head is oval in shape.

5. In a racquet of the type including a frame defining a racquet head, the frame extensions from said racquet head converging to a throat and extending to form a handle; the improvement comprising the division of said handle into two separate symmetrically shaped shafts that are formed and spaced to dispose two separate grips which are offset a distance from and in parallel with, the major axis or centerline of said racquet such that a player can comfortably hold both grips at the same time; the bottom or butt end of said grips being joined by a first torque stabilizer means; the upper or 'thumb' end of said grips being joined by a second torque stabilizer means, said first and second torque stabilizer means providing torsional rigidity to the lower handle portion of said racquet and also a means of adjusting the distance between said grips; said grips being mounted on two separated shafts provided for the purpose of permitting a two-handed hold on said racquet, allowing a player to play 'forehand' with either hand without the need to switch gripholds.

6. A racquet as in claim 5 wherein:

said first torque stabilizer means includes a first internally threaded sleeve of tubing and two threaded ends of the shafts that have passed through the grips and are bent at an angle of 90 degrees with the grips so that the shaft ends are perpendicular to the centerline of the handle; said shaft ends being threaded at one end with a right-hand thread and the other end with a left-hand thread; said first threaded sleeve having an outside surface that is knurled for an easy grip; said first torque stabilizer means permitting the adjustment of spacing the grips apart by rotation of said first threaded sleeve in one direction or the other.

7. A racquet as in claim 6 wherein:

said second torque stabilzer means is identical in construction and mechanization to said first torque stabilizer means, except that two tubes having threaded ends are utilized instead of the bent ends of the shafts, said tubes being welded to said shafts above the upper or 'thumb' end of said grips; said second torque stabilizer means including a second internally threaded sleeve that is attached to said tubes, permitting the adjustment of spacing the grips apart by rotation of said second threaded sleeve in one direction or the other.

8. A racquet as in claim 5 wherein:

a fixed bridge is located and attached in the throat area for the purpose of providing torsional rigidity to the throat of the racquet; said fixed bridge being made of plastic material.

9. A racquet as in claim 5 wherein:

said racquet head is oval in shape.

10. In a racquet of the type including a frame defining a racquet head, the frame extensions from said racquet head converging to a throat and extending to form a handle; the improvement comprising a handle that is formed of two shafts paralleled closely together for most of its length and then flared out in a configuration which mounts two parallel grips offset with the centerline of said handle, a distance apart such that a player can comfortably hold both grips at the same time; a non-adjustable plastic gusset piece being located just above said grips and fastened to said handle, providing torsional rigidity; a fixed bridge made of plastic being located in the throat area and fastened to said shafts, providing torsional rigidity to the throat; said handle and grip configuration permitting a player to play with both hands on the grips at the same time, or with one hand on a grip and the other on the racquet handle.

11. A racquet as in claim 10 wherein:

said racquet head is circular in shape.

12. A racquet as in claim 10 wherein:

said grips are shaped to fit the player's hand.

13. A racquet as in claim 10 wherein:

said grips are set at an angle 12 to 20 degrees with the centerline of the handle to suit the comfort of the player.

* * * * *